US005173309A

United States Patent [19]

Belarde

[11] Patent Number: 5,173,309

[45] Date of Patent: Dec. 22, 1992

[54] APPARATUS FOR FORMING CONCRETE BARRIERS

[76] Inventor: John F. Belarde, 6327 114th Ave. SE., Renton, Wash. 98056

[21] Appl. No.: 571,458

[22] Filed: Aug. 21, 1990

[51] Int. Cl.[5] ..... B28B 13/04

[52] U.S. Cl. ..... 425/64; 249/15; 249/16; 249/20; 249/155; 425/432; 425/456

[58] Field of Search ..... 425/62-64, 425/432, 456, 385; 249/15, 16, 17, 19-21, 155

[56] References Cited

U.S. PATENT DOCUMENTS

| | | | |
|---|---|---|---|
| 2,513,008 | 6/1950 | Davis | 249/20 |
| 3,453,707 | 7/1969 | Johansson | 425/63 |
| 3,497,579 | 2/1970 | Barron | 425/63 |
| 3,665,821 | 5/1972 | Walker | 425/62 |
| 3,740,176 | 6/1973 | Nilsson | 425/64 |
| 3,781,154 | 12/1973 | Herbert et al. | 425/64 |
| 3,792,133 | 2/1974 | Goughnour | 425/64 |
| 4,125,348 | 11/1978 | Martens | 425/385 |
| 4,266,917 | 5/1981 | Godbersen | 425/64 |
| 4,314,798 | 2/1982 | Pettersson | 425/63 |
| 4,761,126 | 8/1988 | del Valle | 425/62 |

FOREIGN PATENT DOCUMENTS

| | | | |
|---|---|---|---|
| 699148 | 11/1979 | U.S.S.R. | 249/20 |

*Primary Examiner*—Richard L. Chiesa
*Attorney, Agent, or Firm*—Christensen, O'Connor, Johnson & Kindness

[57] ABSTRACT

A system for forming an elongate concrete structure (20) which extends in a first direction and includes an outer surface (26) with a textured pattern having concave and convex portions which extend other than in just the first direction. The system comprises an elongate, planar form (32) having a reverse image of the textured pattern on one side (202) thereof, a conventional slipformer (30), the mule (60) of which is modified so as to include only a top wall (64) and a side wall (62), with the opposite side wall of the mule being removed, and a side arm assembly (150) coupled to the slip former for supporting the form so that it engages the mule so as to block off the opening in the mule created by removal on the opposite side wall thereof. The planar form is erected prior to formation of the structure, remains standing during the formation of the structure and is dissassembled a predetermined period of time after the concrete structure has been formed. The side arm assembly slidingly engages the outer surface of the form as the slip former is moved in the first direction.

20 Claims, 5 Drawing Sheets

APPARATUS FOR FORMING CONCRETE BARRIERS

FIELD OF THE INVENTION

The present invention relates to apparatus for continuously forming concrete structures, and more particularly to apparatus for continuously forming concrete road barriers having a textured surface on one side thereof.

BACKGROUND OF THE INVENTION

Equipment for continuously forming concrete barriers of the type commonly referred to as "Jersey" barriers is well known. Such equipment, also known as automated slip formers, includes a form or "mule" for defining the shape of the barrier, a hopper coupled to the mule through which concrete is delivered to the mule, and a drive assembly coupled to the mule and hopper for causing these elements to move along a path extending next to the surface on which the barrier is to be erected. An exemplary piece of such slip forming equipment is manufactured by Miller Formless Company, Inc., of McHenry, Ill., and is identified by model number M-8800.

Known slip forming equipment is well adapted to continuously form horizontally extending concrete traffic barriers having either smooth outer surfaces or outer surfaces having continuous, horizontally extending grooves, ridges, or other concave or convex surface texture. Unfortunately, known slip forming equipment is not adapted to form horizontally extending concrete barriers having vertically extending, transversely extending, or other nonhorizontally extending surface texturing. This limitation of known slip forming equipment is especially undesirable in areas where state or local construction codes require that one surface of concrete road barriers include nonhorizontally extending surface texture. For instance, construction codes in the state of Washington require that, under certain circumstances, the outer surface of concrete traffic barriers installed along the outer edges of bridges include vertically extending striations. At present, such bridge barriers are formed on a noncontinuous, section-by-section basis, at a cost far in excess of that for continuously forming horizontally extending concrete barriers of similar height and thickness.

Equipment is also known for vertically slip forming concrete abutments, silos, and other structures characterized by vertically extending concrete walls. Such equipment is disclosed, for instance, in U.S. Pat. No. 3,453,707 to Johansson, and U.S. Pat. No. 4,314,798 to Pettersson. The Pettersson apparatus includes a yoke and a pair of leg assemblies attached to and extending downwardly from the yoke. The leg assemblies are spaced a predetermined distance from one another, and the apparatus includes means for moving the leg assemblies toward and away from one another. In use, two form halves are positioned between and supported by the leg assemblies. Concrete is then poured between the form halves which are caused to move upwardly in a continuous manner by moving the yoke and leg assemblies upwardly. Although known apparatus for vertical slip forming may be satisfactory employed in the fabrication of vertically extending walls, such apparatus are not adapted to form horizontally extending barriers, or vertically extending walls having other than vertically extending surface texturing.

SUMMARY OF THE INVENTION

The present invention is a system for continuously forming a concrete structure (a) having a predetermined cross-sectional configuration, (b) which extends along an elongate path, and (c) includes an outer surface having a textured pattern comprising concave or convex portions which extend other than just parallel to the elongate path. The system includes a frame, a first form assembly, a second form assembly, a drive system, and a support assembly.

The first form assembly is coupled to the frame and is designed to support a portion of one side of the concrete structure being formed. The second form assembly is designed to support an opposite side of the concrete structure and to form the above-described pattern in the outer surface of the concrete structure. The second form assembly is also designed to coact with the first form assembly so as to enclose an area having a cross sectional configuration corresponding to the predetermined cross sectional configuration of the concrete structure. In practice, the second form assembly is erected prior to the formation of the concrete structure, remains standing during the formation of the structure, and typically is not dissassembled until after the structure has been formed. The drive means is coupled to the first form assembly and to the frame, and is designed to cause the first form assembly to move along the path on which the concrete structure is formed. The support assembly is coupled to the frame and is designed to (a) slidingly engage the second form assembly as the first form assembly is caused to move along the path and (b) support the second form assembly relative to the first form assembly so as to permit the second form assembly to coact with the first form assembly so as to enclose the area in which the concrete structure is formed.

DETAILED DESCRIPTION OF THE PREFERRED EMBODIMENT

Figure 1:
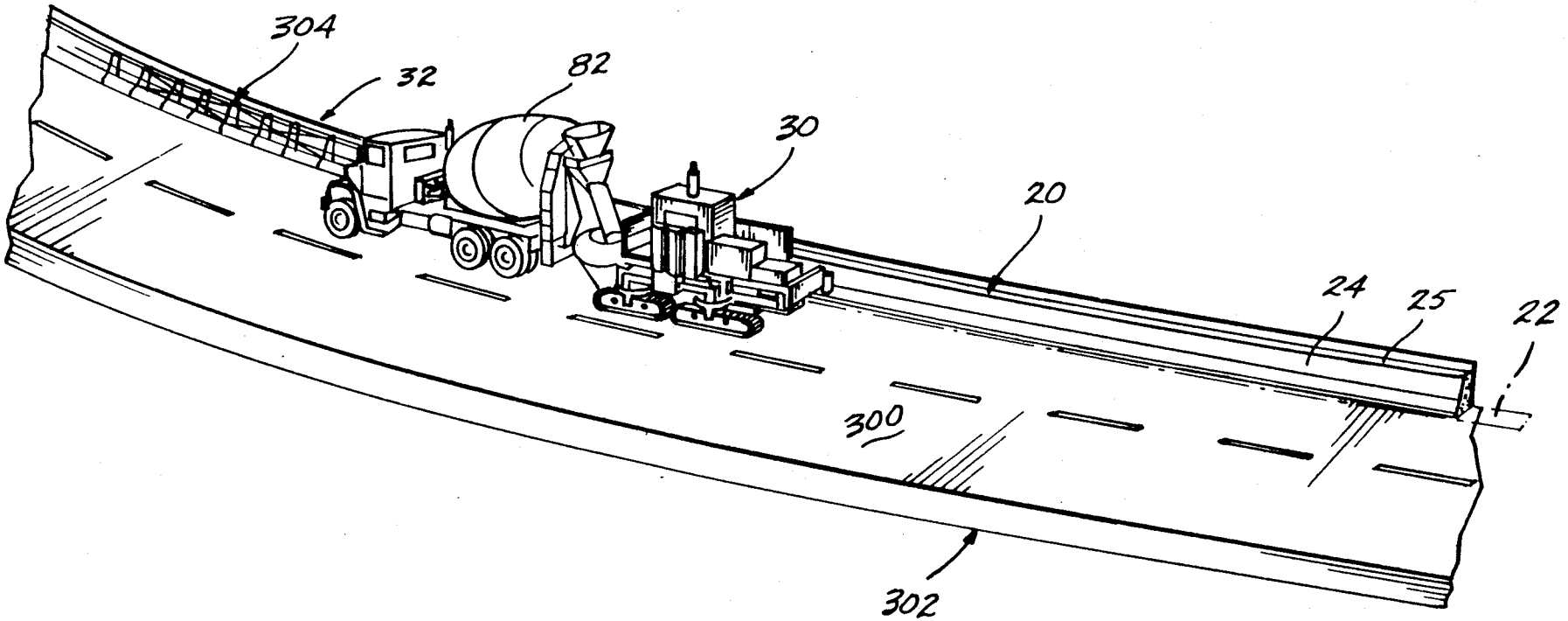
FIG. 1 is a perspective view of a horizontally extending concrete structure being formed by the system of the present invention, the slip former and elongate form of the present system, and a concrete supply truck for delivering concrete to the slip former.
Figure 3:
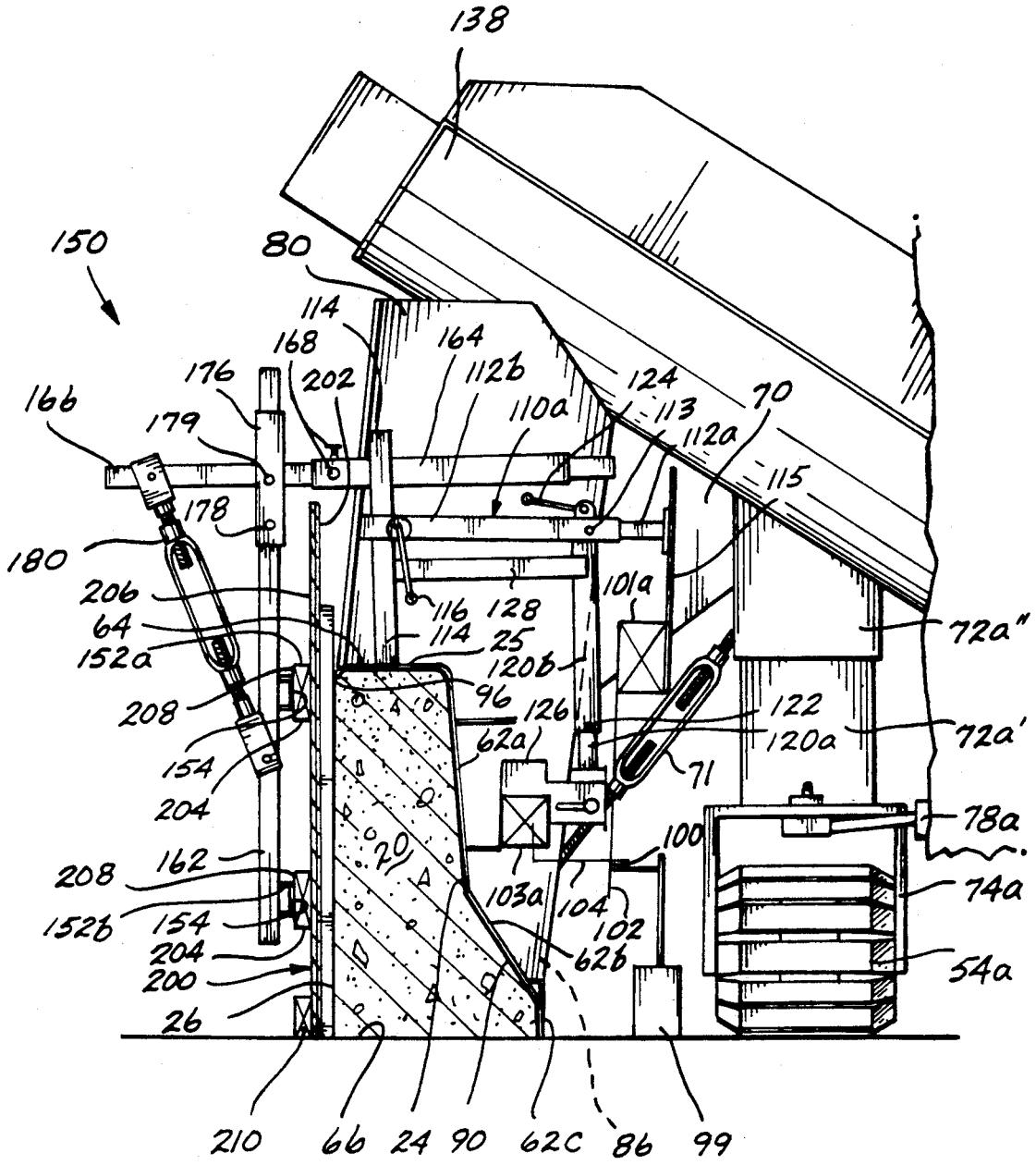
FIG. 3 is a side elevation view of the side of the slip former showing the operative association between the mule and the elongate form, with the concrete structure formed by the present invention being shown in the space enclosed within the mule and the form.

Referring to FIGS. 1 and 3, the present invention is a system for continuously forming a unitary concrete structure 20 which extends along a flat, elongate path 22. Structure 20 includes a slip formed surface 24, an upper surface 25, and a textured surface 26 (FIG. 3)

positioned opposite the slipformed surface 24. As described in greater detail hereinafter, the textured surface 26 has a pattern formed therein that includes portions which extend other than just parallel to the path 22 along which the structure 20 is formed. The concrete structures 20 which may be formed with the present invention include traffic barriers positioned between opposing lanes of traffic (e.g., "Jersey" barriers), curbs, traffic barriers positioned at the outer edges of bridges, and other horizontally extending structures. Thus, the path 22 along which structure 20 is formed includes the median divider strip in a road, the edge of a road, or the edge of the top surface of a bridge. In addition, with certain modifications, the present system may be used to form continuous, vertically extending structures having a textured surface including patterns which extend other than just in the vertical direction.

The present slip forming system includes a slip former 30 and an elongate form 32 which supports one side of the concrete structure 20 being formed and defines the pattern on the textured surface 26 of the structure.

Referring to FIGS. 1–4, slip former 30 is a modified version of a conventional slip former of the type used to slip form unitary, horizontally extending concrete structures such as traffic barriers. One such slip former is manufactured by Miller Formless Company, Inc., of McHenry, Ill., and is identified by model number M-8800. As used herein, to "slip form" means to continuously form an elongate concrete structure which extends along a predetermined path using a form for supporting the wet concrete as it is poured and for defining the configuration of the structure. The form is continuously moved along the path on which the structure is to be formed, with the leading portion of the form receiving the wet concrete used in forming the structure and the trailing portion of the form sliding along and defining the surface configuration of the just-formed portions of the structure.

As described in greater detail below, slip former 30 differs from conventional slip formers of the type discussed above in that it includes a side arm assembly 150, and the mule 60 of the slip former has a modified construction.

Slip former 30 comprises a frame 50, a motor 52 supported on frame 50, and two pairs of endless tracks 54 which are also attached to frame 50. As discussed in greater detail hereinafter, the front pair of tracks **54*a* is coupled to a front steering mechanism 78*a* which causes the front pair of tracks to move simultaneously to the right and to the left independently of the rear pair of tracks 54*b*, and the rear pair of tracks 54*b* is coupled to a rear steering mechanism 78*b* which causes the rear pair tracks to move simultaneously to the right and to the left independently of movement of the front pair of tracks. Steering mechanisms 78*a* and 78*b* are controlled by a control system 98 which is discussed in greater detail below. Endless tracks 54 are coupled with motor 52 by a conventional transmission (not shown) and are adapted to cause slip former 30 to move back and forth along the path 22 on which concrete structure 20** is formed.

Slip former 30 additionally includes a mule 60 for defining the shape and surface configuration of at least one, and typically two, sides of structure 20, and for temporarily supporting portions of the structure during the formation thereof, as discussed hereinafter. The specific size, shape, and design of mule 60 will vary as a function of the size, shape, and surface configuration of the structure 20 to be formed. However, the exemplary embodiment of slip former 30 illustrated in FIG. 2 includes a mule 60 designed for use in forming a traffic barrier positioned along the outer edges of a bridge.

Mule 60 comprises a side wall 62 and an upper wall 64 attached to the upper edge of the side wall. As best seen in FIG. 3, side wall 62 includes an upper portion **62*a*, an intermediate portion 62*b* attached to the lower end of the upper portion, and a lower portion 62*c* attached to the lower end of the intermediate portion. Upper portion 62*a* extends downwardly and slightly outwardly from upper wall 64 so that the included angle between the inner surfaces of upper wall 64 and upper portion 62*a* is about 95°. Intermediate portion 62*b* extends downwardly and outwardly from upper portion 62*a* so that the included angle between the outer surfaces of the upper portion 62*a* and the intermediate portion 62*b* is about 120°. Lower portion 62*c* extends downwardly from intermediate portion 62*b* so as to extend perpendicular to the surface 66 (FIG. 3) on which concrete structure 20** is formed.

In the exemplary embodiment, upper portion **62*a* has a length of 20 inches, intermediate portion 62*b* has a length of 13 inches, and lower portion 62*c* has a length of 4 inches, all as measured along the height of the side wall, as seen in cross section in FIG. 3. Upper wall 64 extends parallel to surface 66 and has a width corresponding to that of top surface of structure 20, e.g., about 15 inches. Both side wall 62 and upper wall 64 extend horizontally for a predetermined length, e.g., about 10 feet, along one side of slip former 30. In the embodiment of slip former 30 illustrated in FIGS. 1–3, the inner surfaces of side wall 62 and upper wall 64 are smooth. However, in the event it is desired to provide one or more grooves in slip formed surface 24 or top surface 25 which extend along the length of concrete structure 20, then side wall 62 and upper wall 64** may include one or more inwardly projecting members (not shown) attached to the inside surfaces of the walls.

Mule 60 includes support structure 67 (FIG. 2) coupled to side wall 62 and upper wall 64 for preventing the walls, particularly side wall 62, from deflecting under a load of wet concrete to be poured into the space defined by the walls. The specific design of support structure 67 may vary significantly, so long as the support structure is capable of preventing the above-noted deflection of the walls of mule 60. However, in the exemplary embodiment of the slip former 30, support structure 67 is made from a plurality of steel plates shaped and attached together in I-beam like configuration. Mule 60 is coupled with frame 50 of slip former 30 by a rigid member 70 (FIG. 3) which is attached to frame 50 and support structure 67. Thus, movement of slip former 30 along path 20 is transmitted to mule 60 via member 70 and support structure 67 so as to cause the mule to move with the remainder of the slip former.

The rigid attachment of mule 60 to frame 50 of slip former 30 is further achieved by turnbuckle assemblies 71, only one of which is shown in FIG. 3. The lower end of turnbuckle assemblies 71 are attached to mule 60 and the upper ends of the turnbuckle assemblies are attached to portions of frame 50 such that the turnbuckles extend at about a 45 degree angle relative to surface 66 on which slip former 30 operates.

Figure 4:
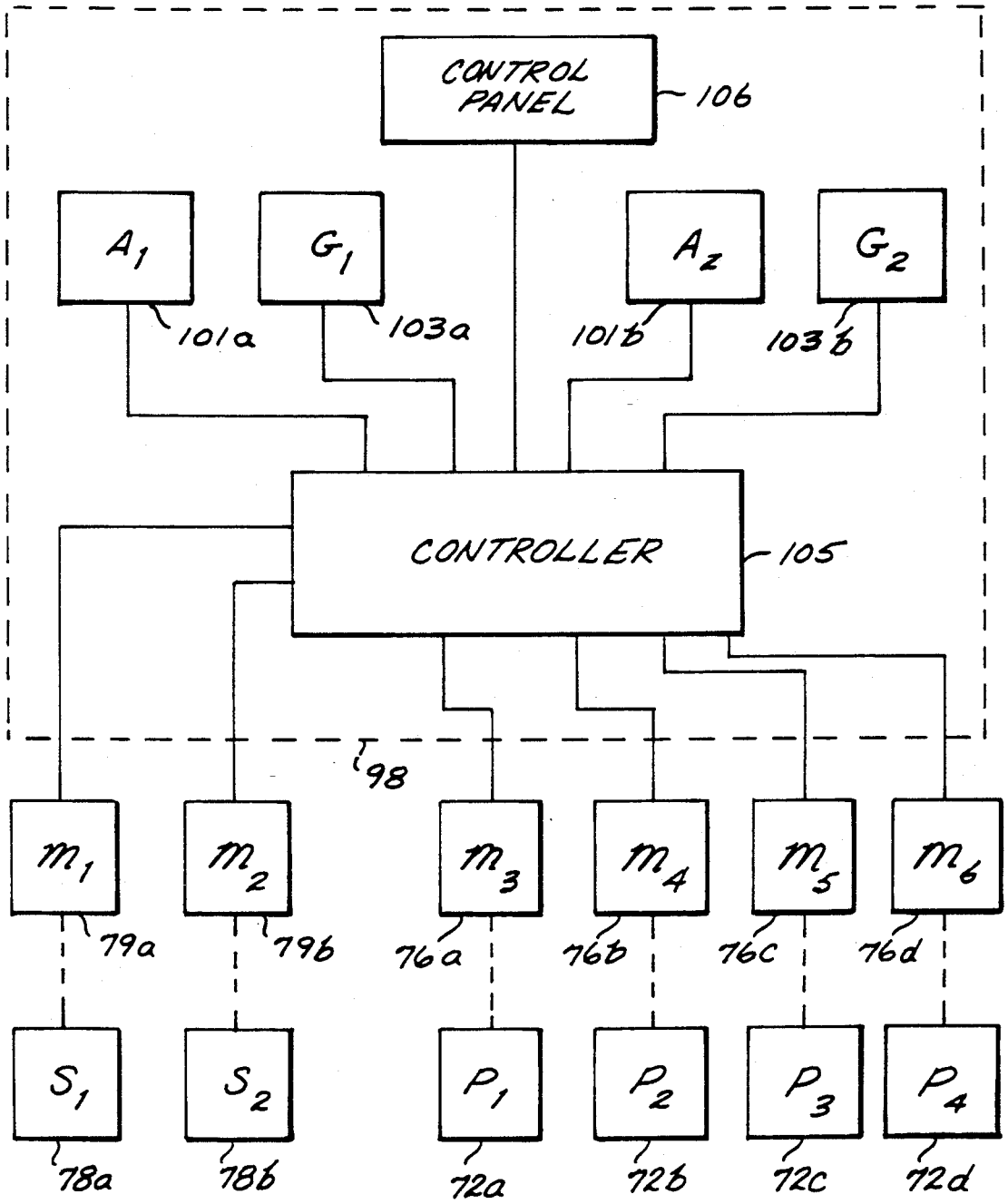
FIG. 4 is a schematic, block diagram illustration of the system for adjusting the position of the mule relative to the path along which the concrete structure is to be formed.

Referring to FIGS. 3 and 4, slip former 30 additionally comprises hydraulic pistons **72*a*, 72*b*, 72*c*, and 72*d*, each of which is associated with a corresponding one of the two pairs of endless tracks 54**. As illustrated in FIG.

3, piston 72*a* includes an inner member 72*a*′ which is slidably mounted in an outer member 72*a*″. Piston 72*a* is constructed so that the overall length of the piston changes as a function of the quantity of hydraulic fluid supplied to the piston. The bottom end of piston 72*a* is coupled with track 54*a*′ via U-shaped bracket 74*a* and the upper end of piston 72*a* is coupled with frame 50 of slip former 30. Piston 72*a* extends vertically upwardly from bracket 74*a* and supports approximately a quarter of the weight of the slipformer. Pistons 72*b*, 72*c*, and 72*d* are similarly constructed and connected between frame 50 and associated ones of tracks 54. As illustrated in FIG. 4, each piston 72*a*–72*d* is associated with a corresponding respective hydraulic motor 76 for supplying hydraulic fluid to or exhausting hydraulic fluid from the associated piston 72 as a function of information provided in a control signal provided to the hydraulic motor, as discussed in greater detail hereinafter. Hydraulic motors 76 are conventional hydraulic motors of the type widely used in hydraulic systems.

As illustrated in FIG. 4, slip former 30 further includes conventional hydraulic steering mechanisms 78*a* and 78*b* for causing front track pairs 54*a* and 54*b*, respectively, to move to the right and left. Inasmuch as steering mechanisms 78*a* and 78*b* are widely used to control the direction of travel of the tracks of conventional slip formers, such steering mechanisms are only schematically illustrated in FIG. 4. It is to be appreciated, however, that the steering mechanisms 78*a* and 78*b* change the direction of travel of track pairs 54*a* and 54*b*, respectively, as a function of the quantity of hydraulic fluid provided to the steering mechanisms.

Slip former 30 additionally comprises hydraulic motors 79*a* and 79*b* for supplying hydraulic fluid to, and exhausting hydraulic fluid from, steering mechanisms, respectively. Hydraulic motors 79*a* and 79*b* are conventional hydraulic motors of the type widely used in the control of hydraulic systems. As discussed in greater detail hereinafter, hydraulic motors 79*a* and 79*b* provide pressurized hydraulic to, or exhaust pressurized hydraulic fluid from, steering mechanisms 78*a* and 78*b*, respectively, as a function of information provided in control signals provided to the hydraulic motors.

Mule 60 includes a hopper 80 through which wet concrete is delivered from supply truck 82 (FIG. 1) to the space 90 enclosed by side wall 62, upper wall 64, and form 32, the physical relation of the latter to walls 62 and 64 being discussed in greater detail hereinafter. Hopper 82 is attached to side wall 62 and upper wall 64 of mule 60 near, i.e., about 2 feet back from, the leading edge 84 of mule 60. Hopper 80 projects upwardly from upper wall 64 of mule 60 and includes a hollow interior 86 (FIG. 2) which is coupled with space 90 via opening 94 (FIG. 2) provided in the side wall and upper wall of the mule. Opening 94 extends horizontally a selected distance, e.g., about 2.5 feet, along the length of mule 60.

Mule 60 differs from mules of conventional slip forming equipment in that it comprises only a side wall 62 and an upper wall 64. Mules of conventional slip formers, on the other hand, include a second side wall positioned opposite side wall 62. Mule 60 includes an opening 96 (FIG. 3) in place of this second side wall.

Slipformer 30 also includes a steering control system 98 (FIG. 4) for controlling the position of slip former 30, and hence mule 60 attached thereto, relative to path 22 by controlling the height of pistons 72*a*–72*d*, and the position of steering mechanisms 78*a* and 78*b*. Control system 98 includes a plurality of string line supports 99 for supporting a string line 100 adjacent path 22. Supports 99 and string line 100 are positioned adjacent path 22 prior to the formation of concrete structure 20, so that as slipformer travels next to path 22 the supports 99 and string line 100 will be received between mule 60 and the adjacent ones of tracks 54. Supports 99 and string line 100 are additionally positioned so that the string line extends parallel to, and is spaced a predetermined distance above, the path 22 along which concrete structure 20 is to be erected.

Control system 98 includes a pair of alignment sensors 101*a* and 101*b* for providing an output signal containing information which varies as a function of the extent of movement of slip former 30 to the right or the left (as seen in FIG. 3) of string line 100. Alignment sensors 101*a* and 101*b* each include a wand 102, as illustrated in conjunction with sensor 101*a* in FIG. 3, which is positioned so as to slidingly engage the left side (as seen in FIG. 3) of string line 100. Wands 102 are spring biased and will change position relative to the sensors 101*a* and 101*b* to which they are attached with changes in the lateral position of slip former 30 relative to string line 100 while still remaining in sliding engagement with the string line. The information in the output signal of sensors 101*a* and 101*b* varies as a function of changes in movement of wands 102 relative to the sensors.

Control system 98 further includes a pair of grade sensors 103*a* and 103*b* for providing an output signal containing information which varies as a function of vertical changes in movement of slip former 30 relative to string line 100. Grade sensors 103*a* and 103*b* each include a wand 104, as illustrated in conjunction with sensor 103*a* in FIG. 3, which is positioned so as to slidingly engage the upper side (as seen in FIG. 3) of string line 100. Wands 104 are spring biased and will change position relative to the sensors 103*a* and 103*b* to which they are attached with changes in the vertical position of slip former 30 relative to string line 100 while still remaining in sliding engagement with the string line. The information in the output signals of sensors 103*a* and 103*b* varies as a function of changes in movement of wands 104 relative to the sensors.

Control system 98 also includes a controller 105 for processing the output signals provided by alignment sensors 101*a* and 101*b* and grade sensors 103*a* and 103*b* so as to generate outputs signals which it provides to hydraulic motors 76*a*–76*d* and 79*a* and 79*b*. These output signals cause the hydraulic motors 76*a*–76*d*, 79*a*, and 79*b* to supply pressurized fluid to, or exhaust pressurized fluid from, pistons 72*a*–72*d* and steering mechanisms 78*a* and 78*b*, respectively, such that mule 60 remains in a predetermined position relative to string line 100, and hence to path 22. Thus, controller 105 is coupled with alignment sensors 101*a* and 101*b*, grade sensors 103*a* and 103*b*, hydraulic motors 76*a*–76*d*, and hydraulic motors 79*a* and 79*b*. Controller 105 comprises a conventional microprocessor which is programmed in known manner so as generate the output signals provided to hydraulic motors 76*a*–76*d*, 79*a*, and 79*b* required to maintain slip former 30, and hence mule 60, in predetermined, spaced relation to string line 10. The specific steps of the software used by controller 105 are not set forth herein inasmuch as they can be readily generated by one of ordinary skill in the art.

Control system 98 further includes a control panel 106 for permitting a user of slip former 30 to direct controller 105 to cause hydraulic motors 76*a*–76*d*, 79*a*, and 79*b* to operate so as to cause pistons 72*a*–72*d* to raise or lower the portion of the slip former supported on the pistons and so as to cause steering mechanisms 78*a* and 78*b* to move track pairs 54*a* and 54*b* to the right and left.

Figure 2:
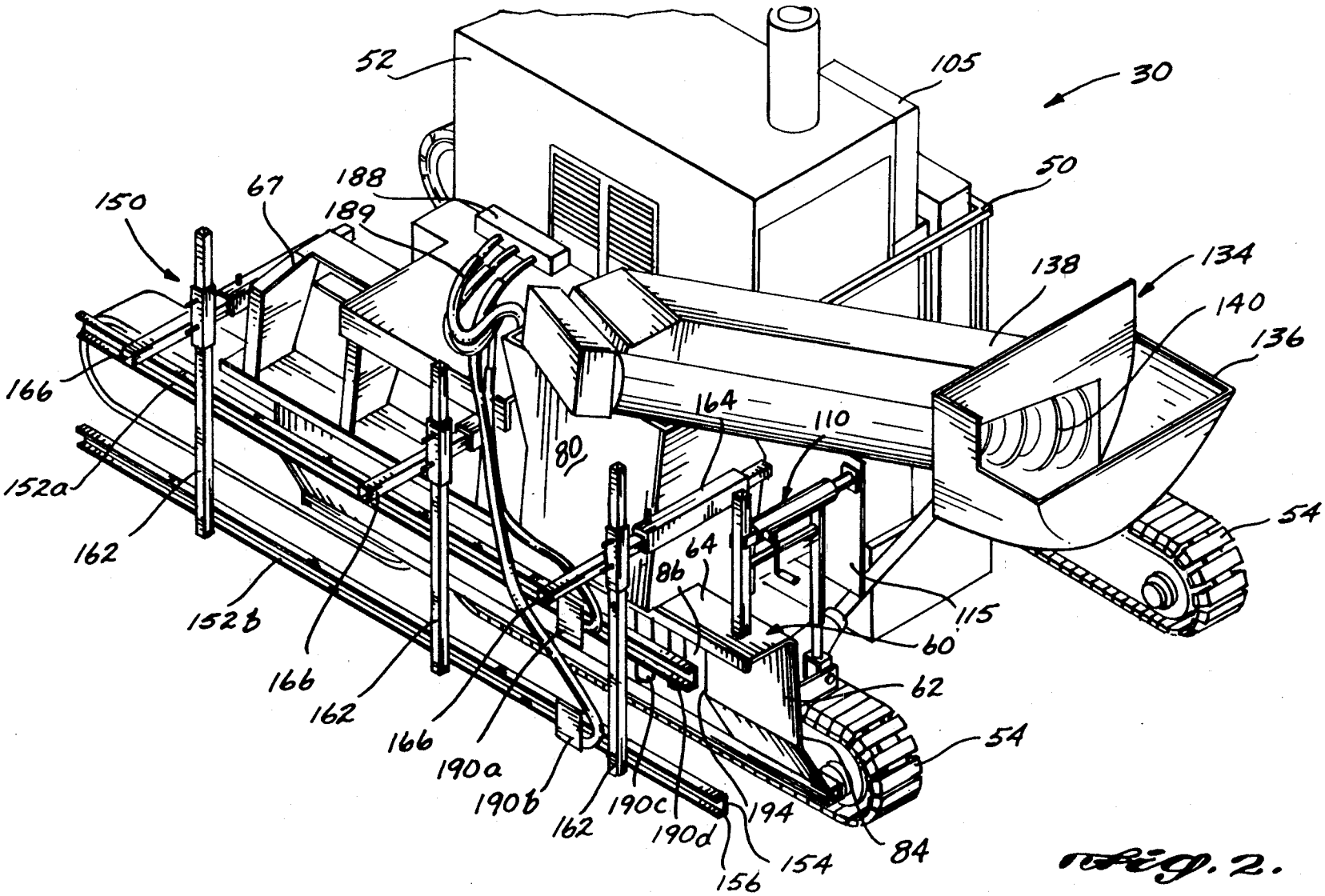
FIG. 2 is a perspective view of the side of the slip former on which a mule and side arm assembly that form part of the slip former are positioned.

Slip former 30 additionally includes two support mechanisms 110 (FIGS. 2 and 3), each for adjusting the position of an associated alignment sensor 101 and grade sensor 103. For instance, support mechanism 110*a* (FIG. 3) is provided for adjusting the position of alignment sensor 101*a* and grade sensor 103*a*. A support mechanism 110 is provided at each end of mule 60, although for clarity of illustration only the one of the support mechanisms adjacent leading edge 84 of mule 60 is shown in FIG. 2.

Support mechanisms 110 each comprise a horizontally extending, telescopic member 112 which includes an inner member 112*a*, and an outer member 112*b* which surrounds and slidably engages inner member 112*a*. A set screw 113 or other means is provided for releasably securing outer member 112*b* in selected axial position relative to inner member 112*a*. Support mechanisms 110 also include a vertically extending member 114 which is attached to and projects upwardly from upper wall 64 of mule 60 and is coupled with the outer end of outer member 112*b*. Support mechanism 110 further includes a plate 115 which is attached to the inner end (right end as seen in FIG. 3) of inner member 112*a* so as to extend perpendicular to surface 66 on which slip former 30 is supported and so that the plane of plate 115 extends parallel to inner surface 202 of form 32. As illustrated in FIG. 3, plate 115 is designed to support an alignment sensor 101 so that the sensor's wand 102 may slidingly engage string line 100. Telescopic member 112 includes an adjustment mechanism 116, such as a rack and pinion drive assembly (not shown), for causing inner member 112*a* to move in and out relative to outer member 112*b*.

Support mechanism 110 further comprises vertically extending telescopic member 120 which includes inner member 120*a* and outer member 120*b*. The latter surrounds and slidably engages inner member 120*a*, and the upper end of outer member 120*b* is attached by welding or other means to horizontal outer member 112*b* adjacent the innermost end (i.e., the right end as seen in FIG. 3) of the outer member. Telescopic member 120 includes a set screw 122 or other means for fixing inner member 120*a* in selected axial relation with outer member 120*b*. Telescopic member 120 includes an adjustment mechanism 124 (FIG. 3), such a rack and pinion drive assembly (not shown), for causing the inner member 120*a* to move up and down relative to the outer member 120*b*.

Support mechanism 110 further includes an L-shaped bracket 126 attached to the bottom end of inner member 120*a*. Bracket 126 is designed to support a grade sensor 103 so that the wand 104 of the latter is positioned to slidingly engage string line 100. Support mechanism 110 also includes a horizontally extending member 128, one end of which is coupled to a midlength portion of vertical member 114 and the other end of which is coupled to outer member 120*b* somewhat below (e.g., 6 inches below) the upper end of the outer member.

Thus, as discussed hereinafter in connection with the description of the operation of the present system, by appropriate manipulation of the various elements of support mechanism 110, the horizontal and vertical positions of alignment sensors 101 and grade sensors 103 may be adjusted as desired.

Slip former 30 also includes transport assembly 134 for receiving wet concrete from a supply truck 82 (FIG. 1) positioned adjacent slip former 30, and for transporting the wet concrete up and into hopper 80. Transport assembly 134 includes an open top chamber 136 for receiving wet concrete supplied from truck 82, an enclosed chute 138 coupling chamber 136 with the upper portion of interior 86 of hopper 80, and an auger 140 disposed in chute 138 for transporting wet concrete from chamber 136 through chute 138 to interior 86 of hopper 80. Auger 140 is driven by motor 52. As noted above, interior 86 of hopper 80 defines a pathway along which wet concrete may be delivered to the space 90 enclosed within form 32 and the walls of mule 60.

Slip former 30 additionally differs from conventional slip formers in that it comprises a side arm assembly 150 for supporting and slidingly engaging form 32. As discussed in detail below, side arm assembly 150 is made from a plurality of elongate, rigid members which are typically made from steel or other material having a high strength, and which can be readily fabricated.

Side arm assembly 150 comprises a pair of horizontally extending rails 152, each comprising a bearing surface 154 for slidingly engaging and bearing against form 32, as discussed in greater detail hereinafter. The support rails 152 typically have a U-shaped channel configuration. Rails 152 extend in parallel with one another and are spaced a predetermined distance, e.g., about 2 feet, apart from one another. Typically, only two rails 152 are required. However, when three or more rails 152 are used, the spacing between adjacent rails will, of course, be less than when two rails are used. Rails 152 are preferably somewhat longer than mule 60, with the leading edges 156 (FIG. 2) of rails 152 being positioned in approximately coplanar relation with leading edge 84 of mule 60.

Side arm assembly 150 includes a plurality of vertically extending supports 162 which are attached by welding or other conventional means to side rails 152 in orthogonal relation therewith. Supports 162 are spaced approximately evenly along the length of rails 152. In the embodiment of support arm assembly 150 illustrated in FIGS. 1–3, three supports 162 are employed. However, alternatively, two or four or more supports 162 may be used.

Side arm assembly 150 further includes a plurality of elongate, hollow sleeves 164 which are open at both ends. Sleeves 164 are attached to hopper 80 or support structure 67, as the case may be, several feet above upper wall 64 of mule 60 so as to extend roughly parallel to surface 66 on which concrete structure 20 is formed. Preferably, sleeves 164 have a length of at least 2 feet, and the outermost end (i.e., the left end as seen in FIG. 3) of the sleeve is positioned above the outermost end (i.e., the left end as seen in FIG. 3) of upper wall 64 of mule 60. One sleeve 164 is provided for each support 162 employed.

Side arm assembly 150 also includes a plurality of elongate, horizontally extending members 166, one for each hollow sleeve 164 employed. Each member 166 is slidably mounted in a corresponding respective sleeve 164, and is sized to make a close sliding fit in the sleeve. The length of each member 166 is additionally selected so that when one end of the member is received in sleeve 164 such that the innermost end (i.e., the right end as seen in FIG. 3) of the member is flush with the innermost end (i.e., the right end as seen in FIG. 3) of sleeve 164, the outermost end of member 166 will project about 2 feet beyond the outermost end of sleeve 164. One or more set screws 168 or other lock means are provided for locking member 166 to sleeve 164 in selected axial relation therewith.

Side arm assembly 150 further includes a plurality of sleeves 176, one for each support 162. Each sleeve 176 is sized to surround and slidably engage a corresponding respective support 162. Each sleeve 176 includes at least one set screw 178 or other lock means for locking the sleeve to the support 162 with which it is associated in selected axial relation therewith. Each sleeve 176 is pivotally mounted at a predetermined location to an associated member 166 via a pin 179. Preferably, this predetermined location is spaced inwardly from the outermost end of member 166 a distance equal to approximately one-third of the overall length of the member.

Finally, support arm assembly 150 comprises a plurality of angle adjustment mechanisms 180, each for adjusting the relative angular relationship between an associated vertical support 162 and the horizontal member 166 associated with the vertical support. One end of each adjustment mechanism 180 is attached to an associated member 166 adjacent the outermost end of the member, and the other end of the adjustment mechanism is slidably attached, e.g., with a conventional slider track assembly, to the vertical support 162 associated with the horizontal member so that the adjustment mechanism may be positioned to extend downwardly from the member 166 to the support 162 at roughly a 45 degree angle relative to the longitudinal axes of the member and the support. In one embodiment of the present system, each adjustment mechanism 180 comprises a conventional mechanical turnbuckle, although other devices for adjusting the relative angular relationship of the members 166 relative to the supports 162 may also be employed.

Slip former 30 additionally comprises a conventional system 188 for providing pressurized hydraulic fluid over five or more lines 189 (only three of which are shown in FIG. 2). Slip former 30 also comprises a plurality of conventional external hydraulic vibrators 190 of the type widely used in the construction of poured concrete structures to eliminate voids in the wet concrete as it is being poured. A suitable external vibrator which may be employed as vibrators 190 is manufactured by Minnich Manufacturing Company, Inc. of Mansfield, Ohio and is identified by model number M-450. To obtain optimal results, it is preferred that an external vibrator 190*a* be attached to upper rail 152*a* of side arm assembly 150 directly opposite hopper 80, i.e., opposite opening 94 in mule 60, and a vibrator 190*b* be similarly attached to lower rail 152*b*.

In addition, it is preferred that three or more conventional, internal hydraulic vibrators 192, only two of which are shown in FIG. 2, be positioned in the lower portion of hopper 80, and in that portion of the space 90 enclosed within form 32 and walls 62 and 64 of mule 60 located directly beneath hopper 80. Two such vibrators are identified in FIG. 2 at 190*c* and 190*d*. A suitable internal vibrator which may be employed as vibrators 192 is manufactured by Wyco Tool Company of Racine, Wis. and is identified by model number 41-9750.

Figure 5:
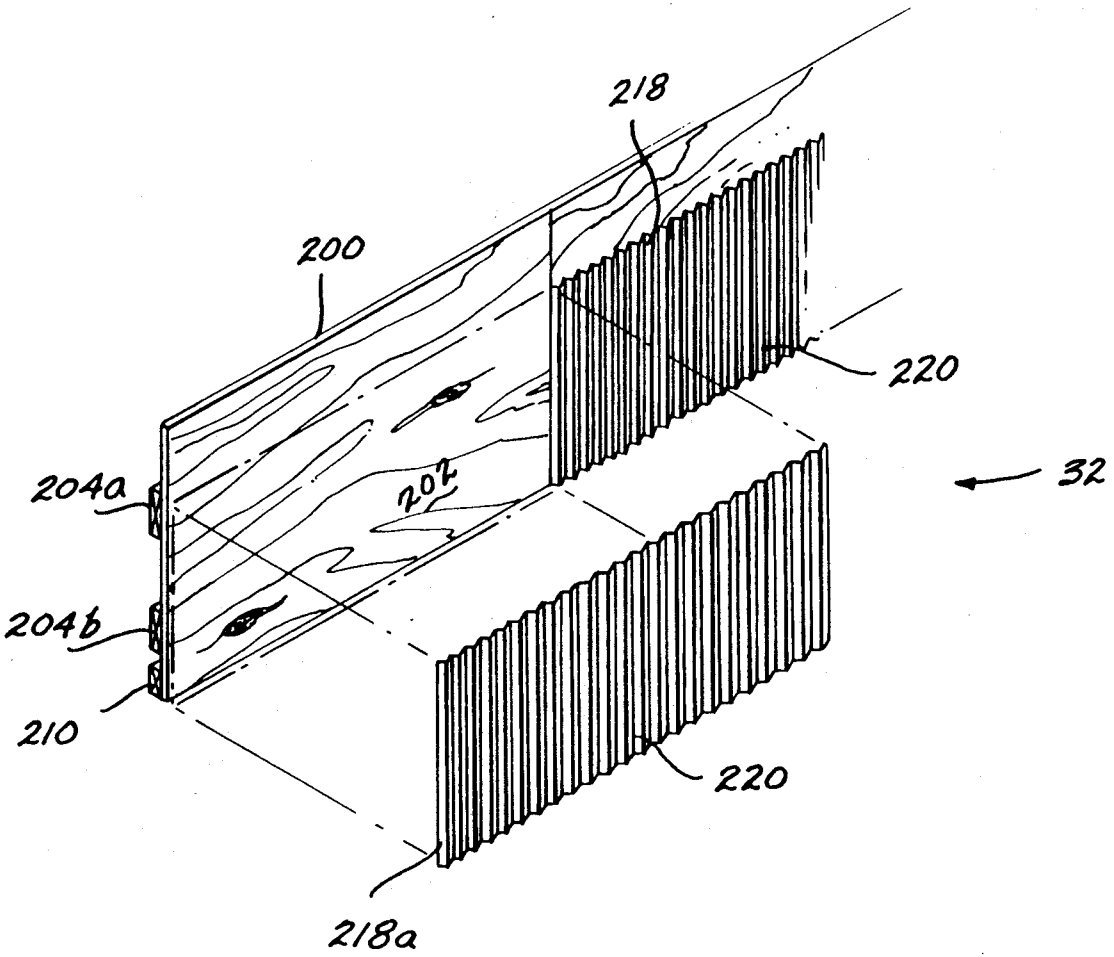
FIG. 5 is an exploded, perspective view of an elongate form created by a system formed in accordance with this invention.

Turning now to FIGS. 1, 3, and 5, form 32 of the present system comprises a continuous elongate wall 200. The latter is preferably made from a plurality of discrete sheets of plywood measuring 4 feet wide by 8 feet long and having a thickness of about 1.125 inch. The plywood sheets are attached end to end using conventional fasteners so as to form an elongate, substantially smooth inner surface 202. Although wall 200 is preferably made from plywood sheets due to their strength, rigidity, and relatively low cost, other materials such as reinforced rigid plastic panels may also be employed.

The height and length of wall 200 will vary as a function of the height and length of the concrete structure 20 being formed, although the wall is preferably at least about 6 inches taller than the height of the concrete structure 20 being formed. Wall 200 must ultimately be as long as the concrete structure 20 being formed. However, under certain circumstance, e.g., when structure 20 is so long that it cannot be formed in a single shift, i.e. longer than about 1000 feet, portions of wall 200 used in forming the beginning portion of the structure may be disassembled after such beginning portion is formed, as discussed hereinafter, and attached to portions of the wall adjacent which structure 20 has not yet been formed. Such "leapfrogging" in the construction of wall 200 will typically reduce the material costs associated with forming a concrete structure 20 so long as the wall is reassembled at a rate such that the length of the wall increases at a speed in excess of the speed at which slip former 30 travels during the construction of the structure, as discussed below.

Form 32 further comprises a plurality of continuous slider tracks 204, one for each of the rails 152 on side arm assembly 150. Slider tracks 204 are attached to the outer surface 206 (FIG. 3) of wall 200 so as to extend parallel to one another and parallel to the bottom edge of wall 200. Slider tracks 204 are spaced apart from one another a distance corresponding to the spacing between rails 152. In addition, slider tracks 204 are vertically positioned on outer surface 206 so that after form 32 is erected, upper track 204*b* will be positioned adjacent an upper portion of the concrete structure 20 being formed and lower track 204*b* will be positioned adjacent an intermediate portion of the structure, as illustrated in FIG. 3. Of course, when selecting the vertical placement of slider tracks 204 on outer surface 206, the spacing between the tracks must always correspond to the spacing between rails 152. Slider tracks 204 are preferably made from dimensional lumber having a nominal cross-sectional dimension of 2 inches wide by 6 inches tall. The pieces of dimensional lumber are butted end to ends when attached to outer surface 206 so as to form a continuous track, with the points of attachment of the pieces being other than at the junction of adjacent pieces of plywood or other material used to fabricate wall 200. As illustrated in FIG. 3, slider tracks 204 include outer surfaces 208 for slidably engaging rails 152, as discussed in greater detail hereinafter.

Optionally, wall 200 may include a continuous base support 210 attached to the bottom end of outer surface 206. Base support 210 cooperates with slider tracks 204 in tying together the discrete panels (e.g., plywood sheets) used to make wall 200.

Wall 200 preferably, although not necessarily, includes a liner 218 attached to inner surface 202 of the wall for defining the texture of outer surface 26 of concrete structure 20. As illustrated in FIG. 5, liner 218 comprises a plurality of discrete panels, one of which is identified at 218*a*, attached end to end so as to form a continuous liner. The panels used to form liner 218 are of the type widely used in forming concrete structure on a noncontinuous, piece-by-piece basis. Such panels are sold, for instance, by L. M. Scofield Company of Los Angeles, Calif. and are identified by the federally registered trademark LITHOTEX®.

The surface configuration of outer surface 220 of liner 218 will vary as a function of the desired texture to be provided on surface 26 of concrete structure 20. However, in all cases, the surface configuration of outer surface 220 will consist of the reverse image of the surface pattern to be provided on outer surface 26. In the embodiment of liner 218 illustrated in FIG. 5, outer surface 220 comprises a plurality of vertically extending ridges and a plurality of vertically extending grooves, with each ridge being positioned adjacent a groove so as to create a pattern of alternately interspersed grooves and ridges. However, the pattern on surface 220 of liner 218 may comprise discontinuous, vertically extending concave or convex portions, transversely extending, continuous or discontinuous, elongate concave or convex portions, continuous or discontinuous curved concave or convex portions, and discontinuous, horizontally extending concave or convex portions. In addition, surface 220 may have a smooth configuration or may comprise continuous, elongate, horizontally extending convex or concave portions, although the formation of a concrete structure 20 using a liner 218 having such a pattern does not take full advantage of the novel attributes of the present invention.

In connection with the following description of the operation of the textured slip forming system of the present invention, reference should be made to FIGS. 1-5. In the following description, the manner in which the present system is used to form a traffic barrier of the type positioned on the top surface 300 of the outermost portion of a bridge 302 will be set forth. This top, outermost surface constitutes the path 22 along which structure 20 is formed.

As the first step in the formation of concrete structure 20, a conventional rebar structure 304 is preferably, although not necessarily, set up along path 22. The height and configuration of rebar structure 304 will vary as a function of the size and configuration of the concrete structure 20 being formed.

Next, or in some cases before rebar structure 304 is erected, form 32 is set up so as to extend along a typically vertically extending plane which extends along path 22 and is positioned adjacent the location where it is desired that outer surface 26 of structure 20 be positioned. Preferably, the length of form 32 is about equal to the length of concrete structure 20 to be formed in a single day. However, when portions of form 32 already used in the formation of structure 20 can be disassembled and reassembled farther along the direction of travel of slip former 30 so that the advancing length of form 32 increases at least as fast as the speed of travel of slip former 30, the length of form 32 may be somewhat less than the length of structure 20 to be formed in a single day.

Form 32 is typically erected by first positioning the discrete panels making up wall 200 adjacent the location where the outer surface 26 of structure 20 is to be positioned, and then attaching the discrete pieces of lumber making up slider tracks 204 to outer surface 206 of wall 200 so as to bridge the junction of adjacent panels. In this assembly, it is important that the discrete panels making up wall 200 be positioned in abutting relation so as to form a continuous wall, and the discrete pieces of lumber making up slider tracks 204 be positioned in abutting relation so as to form a continuous slider track. In some instance, it may be desirable to attach additional fasteners (not shown) at the junction of adjacent panels making up wall 200. If provided, base supports 210 are attached to bottom portions of outer surface 206 of wall 200 so as to tie together the discrete panels making up wall 200. Although it is typically desirable that textured surface 26 of structure 20 extend perpendicular to the surface of path 22, under certain circumstances it may be desirable to incline the textured surface inwardly or outwardly. If such inclination of textured surface 26 is desired, then form 32 is erected so as to lean inwardly or outwardly an amount corresponding to the desired degree of inclination of surface 26. In some cases, it may be desirable to use angled struts or other means for temporarily supporting form 32 prior to the arrival of slip former 30. Finally, the discrete panels making up liner 218 are attached to inner surface 202 of wall 200 so as to form a continuous liner.

Next, a plurality of string line supports 99 are positioned adjacent path 22, and a string line 100 is attached to the supports. As is well known in the art, the supports 99 are positioned so that string line 100 extends parallel to and is positioned in predetermined relation above and to one side of path 22.

Then, slip former 30 is positioned adjacent form 32 at the leading end of path 22 so that mule 60 will coact with form 32 in the manner required to form concrete structure 20, as discussed hereinafter. This positioning is achieved by providing appropriate instructions to control panel 106 of control system 98. These instructions cause controller 105 to operate hydraulic motors **76*a*-76*d*, 79*a* and 79*b* so as to cause slip former 30 to move so that upper wall 64 of mule is positioned parallel to the surface of path 22 and is positioned a distance above the surface equal to the height at which top surface 25 of concrete structure 20 is to be positioned above the surface of path 22, as illustrated in FIG. 3. The position of slip former 30 is additionally adjusted so that the outermost portion (i.e., the right portion as seen in FIG. 3) of upper wall 25 engages surface 220 of liner 218; as illustrated in FIG. 3**.

Next, support mechanisms 110 are adjusted so that the wands 102 and 104 of alignment sensors 101 and grade sensors 103, respectively, engage string line 100. More specifically, such positioning of alignment sensors 101 and grade sensors 103 is accomplished by the combined adjustment of horizontally extending telescopic member 112, via adjustment device 116, and vertically extending telescopic member 120, via adjustment device 124. Once the proper placement of alignment sensors 101 and grade sensors 103 is achieved, telescopic member 112 is locked in place using set screw 113, telescopic member 120 is locked in place using set screw 122.

Next, side arm assembly 150 is positioned so that the rails 152 thereof extend parallel to slider tracks 204, and so that bearing surfaces 154 of rails 150 slidingly engage outer surfaces 208 of slider tracks 204. Such adjustment is achieved by appropriate linear positioning of horizontal members 166 in sleeves 164, and vertical supports 162 in sleeves 176, and by appropriate angular adjustment of vertical supports 162 relative to horizontal members 166 using angle adjustment mechanisms 180. Upon completion of this adjustment of side arm assembly 150, the formation of concrete structure 20 may begin.

To begin this formation, a concrete supply truck 82 delivers wet concrete having a slump ranging from about 1 inch to 2 inches to open top container 136 of transport assembly 134. As used herein, "slump" refers to the amount a conically shaped mass of wet concrete originally supported in a cone 12 inches high will decrease in height, i.e., slump, when the cone supporting the mass of concrete is removed. The concrete delivered from truck 82 is transported by auger 140 up chute 138 where it is dispensed into the interior 86 of hopper 80. The concrete then falls down through opening 94 in mule 60 into space 90 defined by form 32 and walls 62 and 64 of the mule. As the concrete travels downwardly into space 90, any voids in the concrete are eliminated by vibrators 190 and 192. Due to the low slump of the concrete and the action of vibrators 190 and 192, the concrete entirely fills the space 90 in the portion of mule 60 below hopper 80, and causes the concrete to fill all concave portions of liner 218 on form 32.

Next, slip former 30 is caused to move along path 22 in the direction along which concrete structure 20 is to be formed at a rate of about 1 to 10 feet per minute. As a consequence of this movement, trailing portions of mule 60 slidingly engage portions of concrete structure 20 just formed, and impart the final desired configuration to the smooth surface 24 and the upper surface 25 of the structure. The surface configuration of textured surface 26 is formed substantially as soon as the entire space 90 defined by the walls of mule 60 and form 32 is filled with concrete as a consequence of the engagement of the concrete with liner 218 of form 32.

As slip former 30 moves along form 32, the direction of travel of the slip former is controlled so that the outermost portion of upper wall 64 of mule 60 remains in sliding engagement with surface 220 of liner 218. Additionally, as slip former 30 moves along form 32, bearing surfaces 154 of rails 152 slidingly engage the outer surfaces 208 of slider tracks 204. As a consequence of this sliding engagement, side arm assembly 150 opposes outward movement of form 32 caused by the weight of the concrete delivered to space 90. However, the opposing force provided by side arm assembly 150 is only required for a relatively short period of time due to the relatively low slump of the concrete used to form structure 20, and the support provided by rebar structure 304, if provided. By the time the trailing portion of mule 60 has passed by just-formed portions of concrete structure 20, the concrete structure has sufficient structural integrity that the support provided by side arm assembly 150 is no longer required. If struts or other supports are used for temporarily supporting form 32, the latter are removed just before slip former 30 arrives at the location where such struts were employed. Typically, form 32 is allowed to remain standing for about 2 to 24 hours after the concrete structure 20 has been formed, although the form may be allowed to stand for as long as is desired, e.g., several days, after the structure has been formed. So long as concrete supply trucks 82 arrive periodically so as to ensure a continuous supply of concrete is provided to slip former 30, and a form 32 of adequate length is erected, the length of a concrete structure 20 which may be formed with the present system is limited only by labor and machine reliability factors.

As discussed above, the present system is particularly well adapted for use in the formation of horizontally extending concrete structure, such as traffic barriers. However, the basic concept of the present system may also be employed in the formation of vertically extending concrete structures having a surface with a textured pattern comprising concave and convex portions which extend other than just in the vertical direction. To form such vertically extending structures, form 32 is erected so as to extend vertically along a plane adjacent to which the textured surface of the vertically extending structure is to be positioned. Inasmuch as slip former 30 is adapted to travel along a roadbed or other nonvertical surface, alternative structure for causing mule 60 to move vertically so as to form the slip formed surface of the vertically extending structure must be employed. Such structure may, for instance, be similar to the yoke and leg assembly disclosed in U.S. Pat. No. 4,314,798. Of course, the specific size and configuration of mule 60 must be modified to correspond to the desired size and configuration of the slip formed surface of the vertically extending structure being formed.

Although support mechanisms 110 and side arm assembly 150 are manually adjusted, as discussed above, powered adjustment systems for controlling the position of mule 60 and side arm assembly 150 are within the ambit of the present invention. For instance, pneumatic or hydraulic systems of the type well known to those of ordinary skill in the art may be used for adjusting the position of mule 60 and side arm assembly 150.

An important advantage of the present system, as compared to known systems for slip forming concrete structures, is that concrete structures having textured surfaces of the type formerly obtainable only on a non-continuous, piece-by-piece basis may be formed continuously. Importantly, such continuous formation of these concrete structures occurs at a rate of speed equal to that obtained with conventional slip forming equipment for forming concrete structures in which all exposed surfaces of the structure are slip formed.

Although the present system has been described in conjunction with a slipformer having two pairs of tracks, i.e., four tracks, it is to be appreciated that the present system may be used with three-track or even two-track slipformers. Additionally, the present system has been described in connection with a slipformer having a mule mounted on one side thereof. The present system may also be used with a straddle-type slipformer in which the concrete structure being formed passes between the tracks of the slipformer. Such a straddle-type slipformer must be tall enough to pass over form 32 and concrete structure 20.

Since certain changes may be made in the above system without departing from the scope of the invention herein involved, it is intended that all matter contained in the above description or shown in the accompanying drawings shall be interpreted in an illustrative and not in a limiting sense.

The embodiments of the invention in which an exclusive property or privilege is claimed are defined as follows:

1. A system for continuously forming a concrete structure that extends in a substantially horizontal direction and has a predetermined cross-sectional configuration, the system comprising:

a frame;

first form means, coupled to said frame, for supporting a portion of one side of a concrete structure being formed;

second form means for supporting at least a portion of an opposite side of the concrete structure, said second form means being designed to coact with said first form means so as to enclose an area having a cross-sectional configuration corresponding to the predetermined cross-sectional configuration of the concrete structure, wherein said second form means is fixed with respect to a surface on which the concrete structure is formed;

drive means coupled to said first form means and to said frame for causing said frame and said first form means to move in said substantially horizontal direction; and support means, coupled to said frame so that said drive means causes said support means to move with said first form means in said substantially horizontal direction, for supporting successive portions of said second form means relative to said first form means as said drive means causes said first form means to move in said substantially horizontal direction so as to permit said first form means to coact with said second form means so as to enclose successive areas having a cross-sectional configuration corresponding to the predetermined cross-sectional configuration of the concrete structure.

2. A system according to claim 1, wherein said first form means includes a first wall having a configuration, as viewed in cross section, corresponding to the cross-sectional configuration of said one side of the structure.

3. A system according to claim 2, wherein said first wall includes an upper end, and said first form means further includes a second wall attached to said upper end of said first wall, said second wall being adapted to define the configuration and surface pattern of an upper surface of the structure.

4. A system according to claim 1, wherein said second form means includes an elongate planar form adapted to be installed so as to extend in said substantially horizontal direction, said form having an inner surface and an outer surface.

5. A system according to claim 4, wherein said inner surface includes a master pattern comprising the reverse image of a pattern to be provided on the opposite side of the structure.

6. A system according to claim 5, wherein said master pattern comprises a plurality of elongate portions, the elongate axes of which portions extend perpendicular to said substantially horizontal direction.

7. A system according to claim 5, wherein said master pattern comprises a plurality of curved portions.

8. A system according to claim 5, wherein said master pattern comprises a plurality of elongate portions, the elongate axes of which portions extend transversely to said substantially horizontal direction.

9. A system according to claim 1, wherein said second form means includes bearing plate means for providing at least one continuous surface extending in said substantially horizontal direction.

10. A system according to claim 9, wherein said bearing plate means comprises two continuous, elongate members which extend in parallel in said substantially horizontal direction, said members being spaced a predetermined distance from one another.

11. A system according to claim 1, said second form means including bearing plate means, further wherein said support means comprises slide means for slidingly engaging said bearing plate means as said support means is caused to move in said substantially horizontal direction by said drive means.

12. A system according to claim 11, wherein said slide means comprises:

a slide assembly for slidingly engaging said bearing means;

a support assembly coupled to said frame and said slide assembly for supporting said slide assembly in a selected position relative to said second frame means as said slide assembly slidingly engages said bearing means; and adjustment means coupled to said support assembly for adjusting the position of said slide assembly relative to said second form means.

13. A system according to claim 1, further comprising virbration means mounted adjacent said first form means for eliminating voids in wet concrete delivered to said area enclosed by said first and second form means.

14. A system according to claim 13, wherein said vibration means comprises at least one vibrator positioned proximate to said support means and at least one vibrator positioned proximate to said first form means.

15. A system according to claim 1, wherein said drive means includes:

first means for causing said first form means to move back and forth along a first axis extending perpendicular to said substantially horizontal direction; and second means for causing said first form means to move back and forth along a second axis extending perpendicular to said first axis and to said substantially horizontal direction.

16. A system according to claim 1, wherein said second form means includes a three-dimensional pattern on its inner surface designed to form a corresponding pattern in the outside surface of the opposite side of the concrete structure, said three-dimensional pattern on said inner surface including concave or convex portions appearing in random or regular sequence, as desired, that extend other than just in the substantially horizontal direction.

17. A device for slip-forming a concrete barrier along a selected substantially horizontal path, the device being designed for use with a form which extends along, and is fixed relative to, the path and is designed to support and define the configuration of one side of the barrier, the form having an inner surface which engages the one side of the barrier, the device comprising:

a frame;

mule means coupled with said frame for supporting, and defining the configuration of an opposite side of, the concrete barrier, said mule means comprising a first wall having an end, a second wall attached to said end of said first wall so as to extend transversely to said first wall, and an opening opposite said first wall;

drive means coupled to said frame and said mule means for causing said mule means to move along the path; and support means coupled to said frame for supporting said mule means and the form in selected, mutually spaced relation so that said mule means coacts with said form so as to block said opening in said mule means as said mule means is caused to move along said path by said drive means, wherein said support means comprising slide means for slidingly engaging and supporting an outer surface of the form as said mule means is caused to move along said path by said drive means.

18. A device according to claim 17, wherein said slide means comprises:

at least one rail which extends parallel to the path and is designed to slidingly engage the outer surface of the form;

a plurality of supports which extend transversely to, and are attached to, said at least one rail;

a support assembly attachable to said plurality of supports for coupling said plurality of supports with said frame and for adjusting the position of said plurality of supports relative to said frame.

19. A device according to claim 17, wherein said mule means includes an aperture extending through said first and second walls through which concrete may be delivered to said mule means.

20. In an automated slip-former for forming an elongate concrete barrier extending along a substantially horizontal path, the slip-former comprising a frame, drive means coupled with the frame for causing the frame to move along the path, a mule attached to the frame for supporting and defining the configuration of the concrete barrier to be formed, the mule comprising an inner wall, an outer wall, and an upper wall coupled to said inner and outer walls, and a hopper assembly coupled with the mule for delivering concrete to the mule, the improvement wherein:

said mule includes an opening in said outer wall; and said slip former additionally comprises support means, coupled to said frame so as to be moved by the drive means along the path, (a) for supporting successively encountered portions of a pre-erected form extending along the path, as said drive means causes said support means to move along the path, in predetermined spaced relation to said mule so as to block said opening in said outer wall and prevent said portions of the form from moving away from the path, and (b) for detecting changes in grade of the path and adjusting the position of said mule as a consequence of detected changes in grade so as to ensure the barrier has a substantially constant height along its length.

* * * * *